US010159627B2

(12) United States Patent
Milante

(10) Patent No.: US 10,159,627 B2
(45) Date of Patent: Dec. 25, 2018

(54) CHILD-RESISTANT VIAL

(71) Applicant: ÉcoloPharm Inc., Chambly (CA)

(72) Inventor: Sandrine Milante, Chambly (CA)

(73) Assignee: ÉCOLOPHARM INC., Chambly (CA)

( * ) Notice: Subject to any disclaimer, the term of this patent is extended or adjusted under 35 U.S.C. 154(b) by 783 days.

(21) Appl. No.: 14/743,494

(22) Filed: Jun. 18, 2015

(65) Prior Publication Data

US 2015/0366755 A1 Dec. 24, 2015

Related U.S. Application Data

(60) Provisional application No. 62/014,257, filed on Jun. 19, 2014.

(51) Int. Cl.

| | |
|---|---|
| ***A61J 1/03*** | (2006.01) |
| ***A61J 1/14*** | (2006.01) |
| ***B65D 43/22*** | (2006.01) |
| ***B65D 43/02*** | (2006.01) |
| ***B65D 43/16*** | (2006.01) |
| ***B65D 50/04*** | (2006.01) |
| ***B65D 51/24*** | (2006.01) |
| *A61J 1/06* | (2006.01) |

(52) U.S. Cl.

CPC ..... *A61J 1/1425* (2015.05); *A61J 1/03* (2013.01); *B65D 43/0218* (2013.01); *B65D 43/162* (2013.01); *B65D 43/22* (2013.01); *B65D 50/045* (2013.01); *B65D 51/245* (2013.01); *A61J 1/065* (2013.01); *B65D 2203/00* (2013.01); *B65D 2215/02* (2013.01); *B65D 2251/1016* (2013.01); *B65D 2543/00509* (2013.01); *B65D 2543/00842* (2013.01)

(58) Field of Classification Search

CPC ..... A61J 1/1425; B65D 2543/00842; B65D 2251/1016

USPC ..... 215/203, 237, 235, 216, 280; 220/833, 220/834, 254.3

See application file for complete search history.

(56) References Cited

U.S. PATENT DOCUMENTS

| | | | | |
|---|---|---|---|---|
| 4,749,093 | A | 6/1988 | Trick | |
| 4,813,563 | A | 3/1989 | Ogden et al. | |
| 5,031,784 | A * | 7/1991 | Wright | B65D 50/045 215/211 |

(Continued)

FOREIGN PATENT DOCUMENTS

WO 2011026934 A1 3/2011

*Primary Examiner* — Anthony Stashick
*Assistant Examiner* — Raven Collins
(74) *Attorney, Agent, or Firm* — BCF LLP

(57) ABSTRACT

The possibility that a child inadvertently unlocks a child-resistant vial by triggering the latch with his teeth is avoided by preventing access to the latch from under the cap. This is achieved by covering all sides of the latch with the exception of the front face thereof intended to be used to trigger the latch while the cap is lifted. Improvement of the humidity barrier in such a vial is achieved by closing the vial container with a cap including a recess that defines inner and outer peripheral walls in the cap. The inner and outer walls together define an annular gap that is configured to complementary receive the peripheral flange of the container. Both the edge of the inner wall of the cap and the inner peripheral wall of the container are provided with sealing rings that are axially distanced when the cap closes the vial container.

23 Claims, 8 Drawing Sheets

(56) References Cited

U.S. PATENT DOCUMENTS

| | | | | |
|---|---|---|---|---|
| 5,984,122 | A * | 11/1999 | Barker | A61J 7/02 116/308 |
| 7,854,895 | B2 | 12/2010 | Gallagher et al. | |
| 8,167,156 | B2 * | 5/2012 | Milante | A61J 1/03 215/209 |
| 8,251,252 | B2 * | 8/2012 | Giraud | B65D 50/061 215/24 |
| 2006/0000833 | A1 * | 1/2006 | Boots | B65D 43/162 220/254.3 |
| 2006/0231445 | A1 * | 10/2006 | Watson | B65D 23/14 206/459.1 |
| 2009/0145876 | A1 | 6/2009 | Kawamura et al. | |
| 2009/0166361 | A1 | 7/2009 | Lourenco | |
| 2011/0127269 | A1 | 6/2011 | Bucholtz et al. | |
| 2015/0225139 | A1 * | 8/2015 | Baker | B65D 25/04 206/45.24 |

* cited by examiner

CHILD-RESISTANT VIAL

CROSS-REFERENCE TO RELATED APPLICATIONS

This application claims the benefit of U.S. Provisional Application No. 62/014,257, filed on Jun. 19, 2014, the contents of which are incorporated by reference herein.

BACKGROUND

The present disclosure generally relates to child-resistant safety vials. More specifically, the present invention relates to a child-resistant vial which is also humidity-proof. The use of such child-resistant vials is well-known to contain, store and distribute medications.

Many types of vials exist to provide prescription medication to users. The simplest model consists in a container and an independent cap so mounted to the container that it can be removed simply by pulling on the cap.

Child-resistant vials have been known for some times. They come in many flavours. According to one type of child-resistant containers, the interior of the cap is provided with a liner that exerts a pressure onto the container for preventing the vial from being open easily, for example by children. A drawback of this first type of vials is that they require a first mold for the container and a second mold for the cap. Their assembly is also a two-step process considering the assembly of the liner in the cap and then the assembly of the cap onto the vial.

Another well-known type of child-resistant vials is the arrow-type vial. This vial includes a container having a groove near its opening and a cap provided with a tooth; the cap being removable only when the tooth and groove are aligned. Arrows are provided on both the cap and the container to guide a user in aligning the tooth and groove. This type of vials still requires a two-step molding process.

The U.S. Pat. No. 8,167,156 issued to Milante on May 1, 2012, titled "Convertible Child Resistant Vial" which is incorporated herein by reference, teaches a child-resistant vial having a first latching element in the form of a tooth on the container and a second latching element in the form of a tooth-receiving notch on the cap. The notch is configured to automatically lock the tooth when the cap closes the container. The vial, which is integral to the container, is of the press-and-lift type, i.e. that it can be opened by pressing onto the tooth while lifting the cap. The vial proposed by Milante can be converted into a non-child-resistant vial by the easy removal of the tooth.

It has been found, in extremely rare occasions while conducting safety tests, that the vial proposed by Milante was capable of being opened by an infant using his/her teeth.

It has also been found desirable to provide a similar vial with an improved barrier against humidity.

SUMMARY

The problem of the possibility that a child inadvertently unlocks a child-resistant vial by triggering the latch with his teeth is solved by preventing access to the latch from under the cap. This is achieved for example by covering all sides of the latch with the exception of the front face thereof that is intended to be used to trigger the latch while the cap is lifted.

Improvement of the humidity barrier in such a vial is achieved for example by closing the vial container with a cap having an inner annular wall and outer skirts together defining an annular gap that complementary receives the peripheral flange of the container. Both the edge of the inner wall and the inner peripheral wall of the container are provided with sealing rings that are axially distanced when the cap closes the vial container.

In some embodiment, the inner peripheral wall of the cap defines a circular depression onto the cap that is configured to removably receive an identification element.

According to an illustrated embodiment, there is provided a child-resistant vial comprising:

a container having a first peripheral skirt provided with an edge that includes a peripheral flange;

a cap pivotally mounted to the container via a hinge that is integral to both the cap and container; the container being closable by pivoting the cap onto the container; the cap having a second peripheral skirt that generally overlays the first peripheral skirt in a complementary fashion when the container is closed by the cap; the second skirt having an edge that abuts the peripheral flange of the first skirt when the container is closed by the cap so as to close access to the edge of the second skirt;

a first latching element in the form of a tab that protrudes from the first skirt generally parallel thereto and that has a free distal end;

a second latching element, in the form of a cut out portion in the second skirt, that cooperates with the tab to lock the vial when the container is closed by the cap; when the vial is locked, the tab is prevented from being released from the cut out portion unless simultaneous pressing on the tab and pulling on the cap; and a tab guard on the first skirt, that closes access to the free end of the tab when the container is closed by the cap.

In accordance to another illustrated embodiment, there is provided a child-resistant vial comprising:

a child-resistant vial comprising:

a container having a first peripheral skirt provided with an edge that includes a peripheral flange;

a cap pivotally mounted to the container via a hinge that is integral to both the cap and container; the container being closable by pivoting the cap onto the container; the cap having an second peripheral skirt that generally overlays the first peripheral skirt in a complementary fashion when the container is closed by the cap; the second skirt having an edge that abuts the peripheral flange of the first skirt when the container is closed by the cap so as to prevent access to the edge of the second skirt; the cap having a recess defining internal and external walls of the cap, yielding a gap therebetween that receives an upper portion of the first skirt therein; each of an inner wall of the container and an inner wall of the internal wall of the cap includes a sealing ring;

a first latching element in the form of a tab that protrudes from the first skirt generally parallel thereto and that has a free distal end;

a second latching element in the form of a cut out portion in the second skirt, that cooperates with the tab to lock the vial when the container is closed by the cap; when the vial is locked, the tab is prevented from being released from the cut out portion unless simultaneous pressing on the tab and pulling on the cap; and a tab guard on the first skirt, that prevents access to the free end of the tab when the container is closed by the cap.

In accordance to still another embodiment, there is provided a child-resistant vial comprising a container, a cap hingedly mounted to the container, and a latch mounted to both the container and the cap therebetween; the latch being automatically locked when the container is closed by the cap; the latch including a trigger for its unlocking and the latch being openable by simultaneously pulling on the cap and pressing on the trigger; the container further comprising a trigger guard for closing access to the trigger from all sides except from an inner face of the trigger.

It is believed that the meaning of the expression "child-resistant" is well-known in the art. It should therefore not be limited herein in any ways. The expression child-resistant should be construed herein to include something or an operation that cannot be executed by a typical child or by a typical person having limited abilities with his/her hands, such as arthritics. This includes, without limitations, operations which can only successively be performed by combining at least two actions.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements.

Other objects, advantages and features will become more apparent upon reading of the following non-restrictive description of illustrative embodiments thereof, given by way of example only with reference to the accompanying drawings.

DETAILED DESCRIPTION

Figure 1:
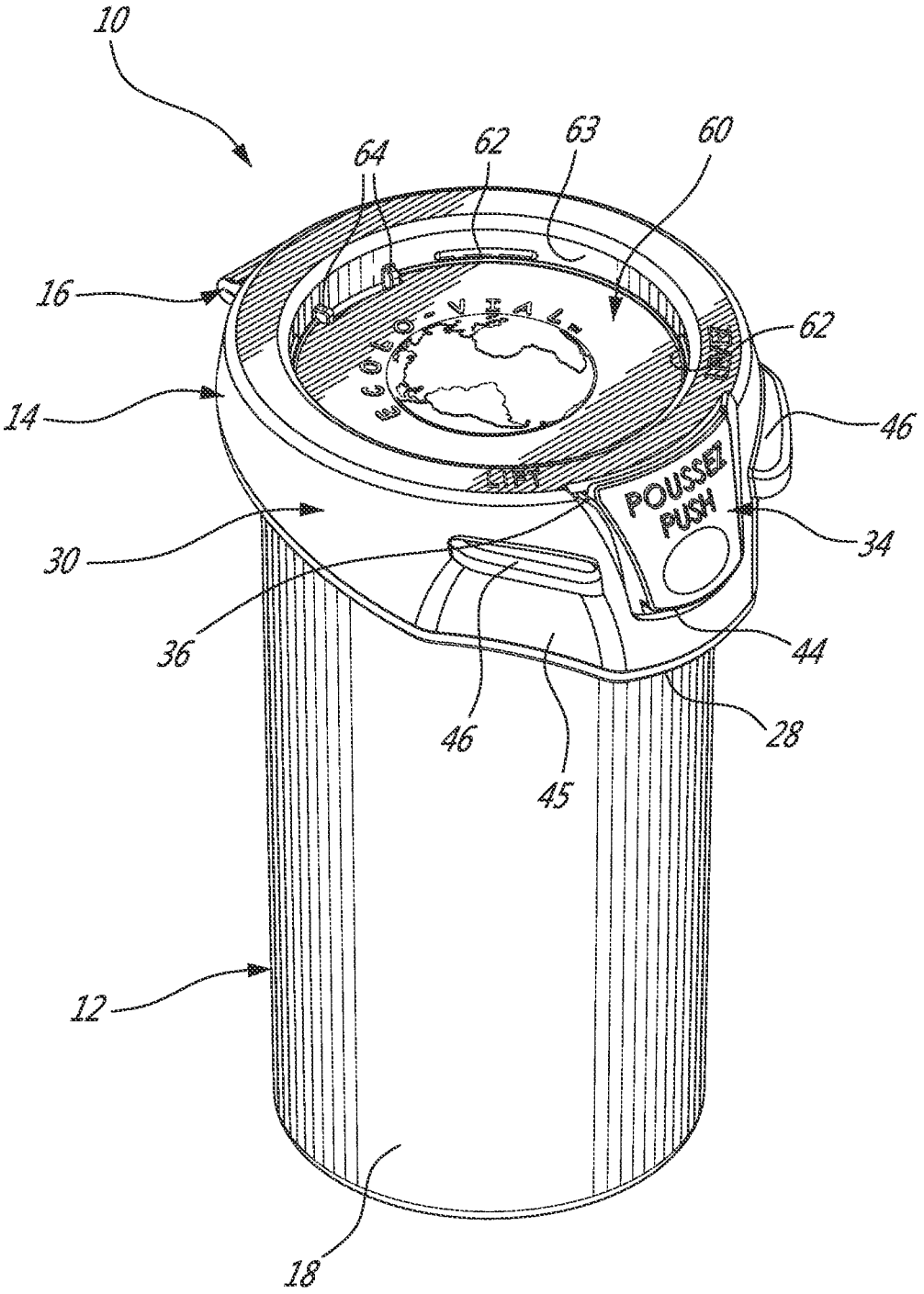
FIG. 1 is a perspective view of a vial according to a first embodiment, the vial being illustrated closed by the cap.
Figure 2:
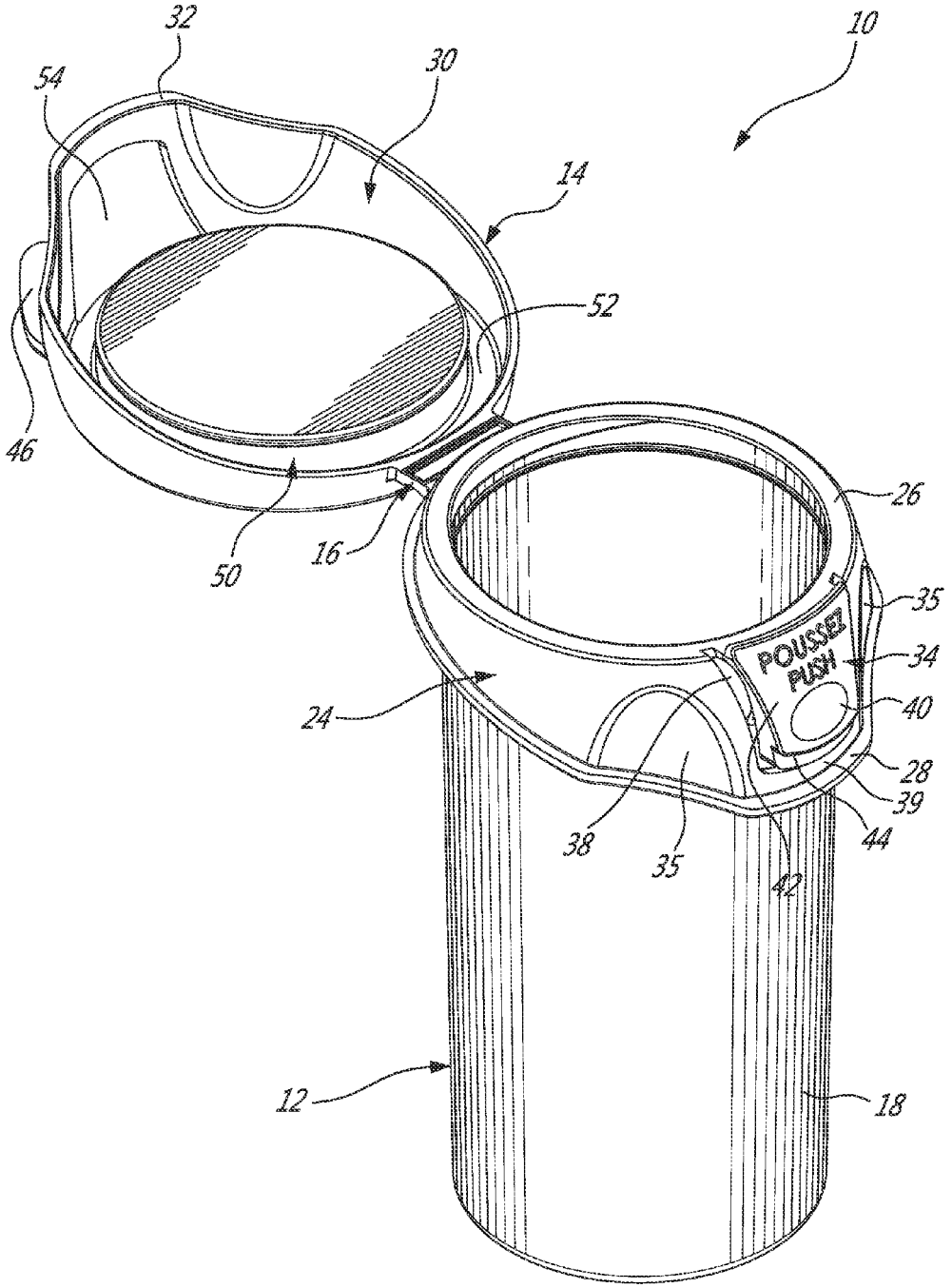
FIG. 2 is a perspective exploded view of the vial from FIG. 1, showing the vial opened.
Figure 3:
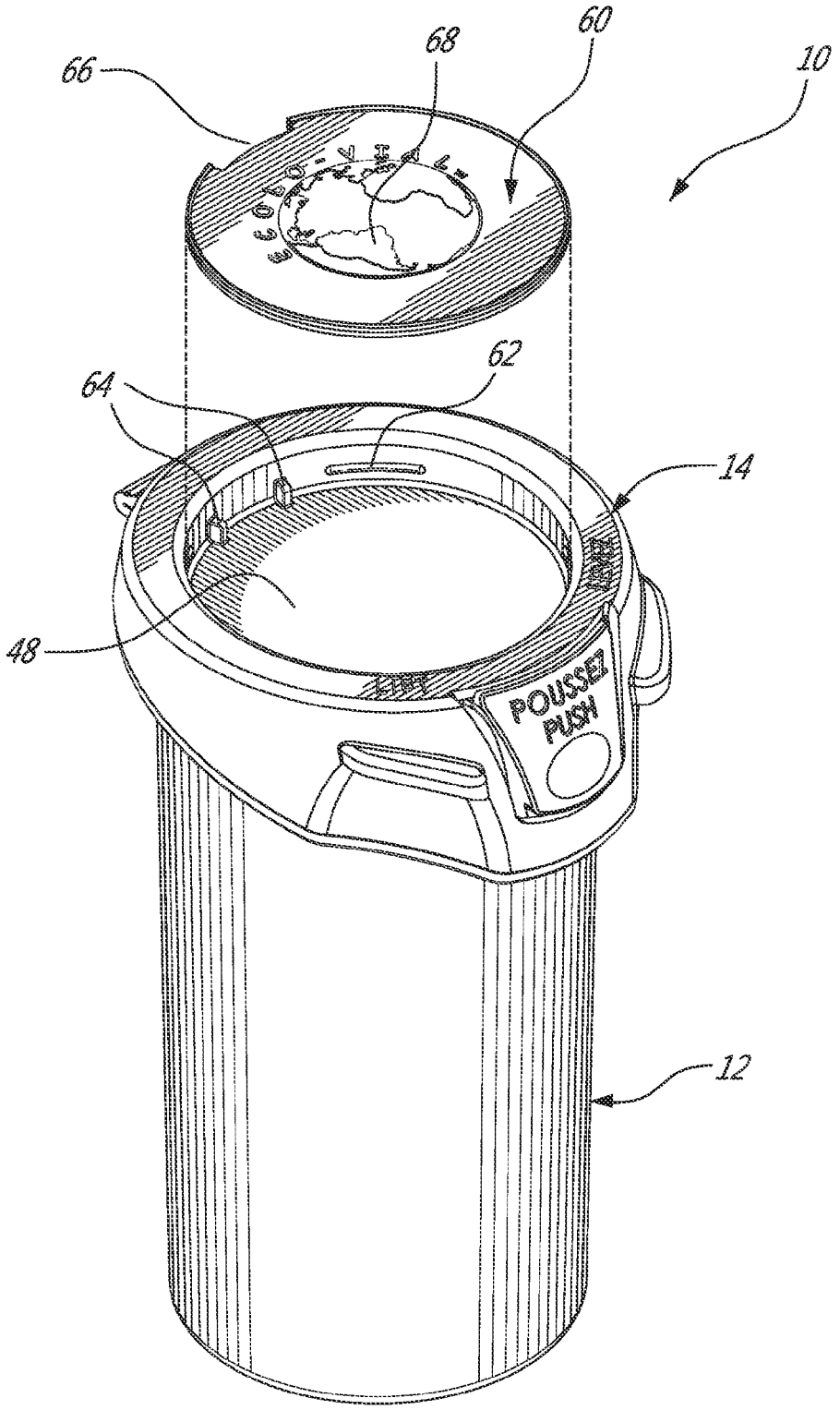
FIG. 3 is a perspective view of the vial from FIG. 1, showing the identification token removed from the cap.
Figure 4:
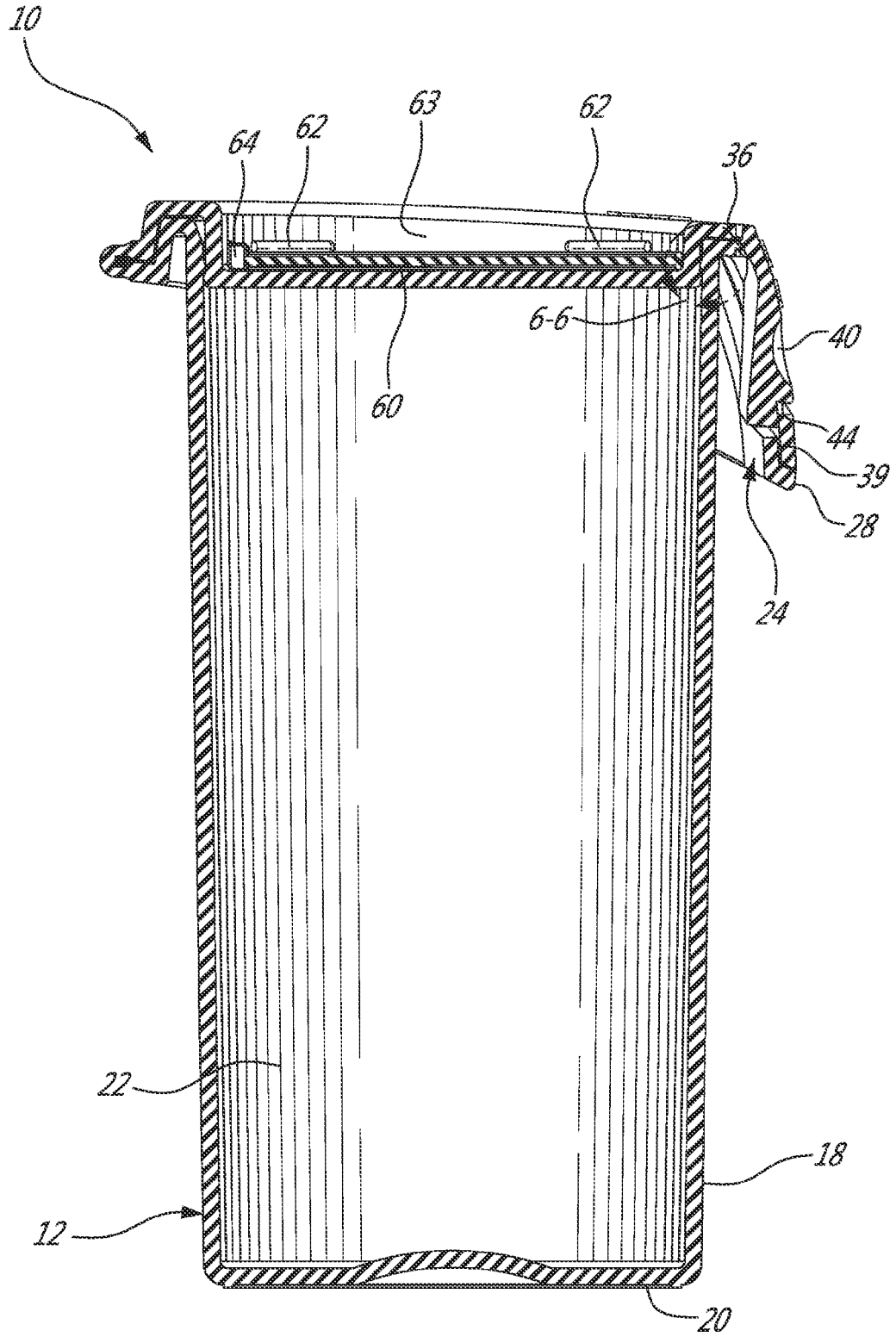
FIG. 4 is a side sectional view of the vial from FIG. 1, the vial being illustrated closed by the cap.
Figure 5:
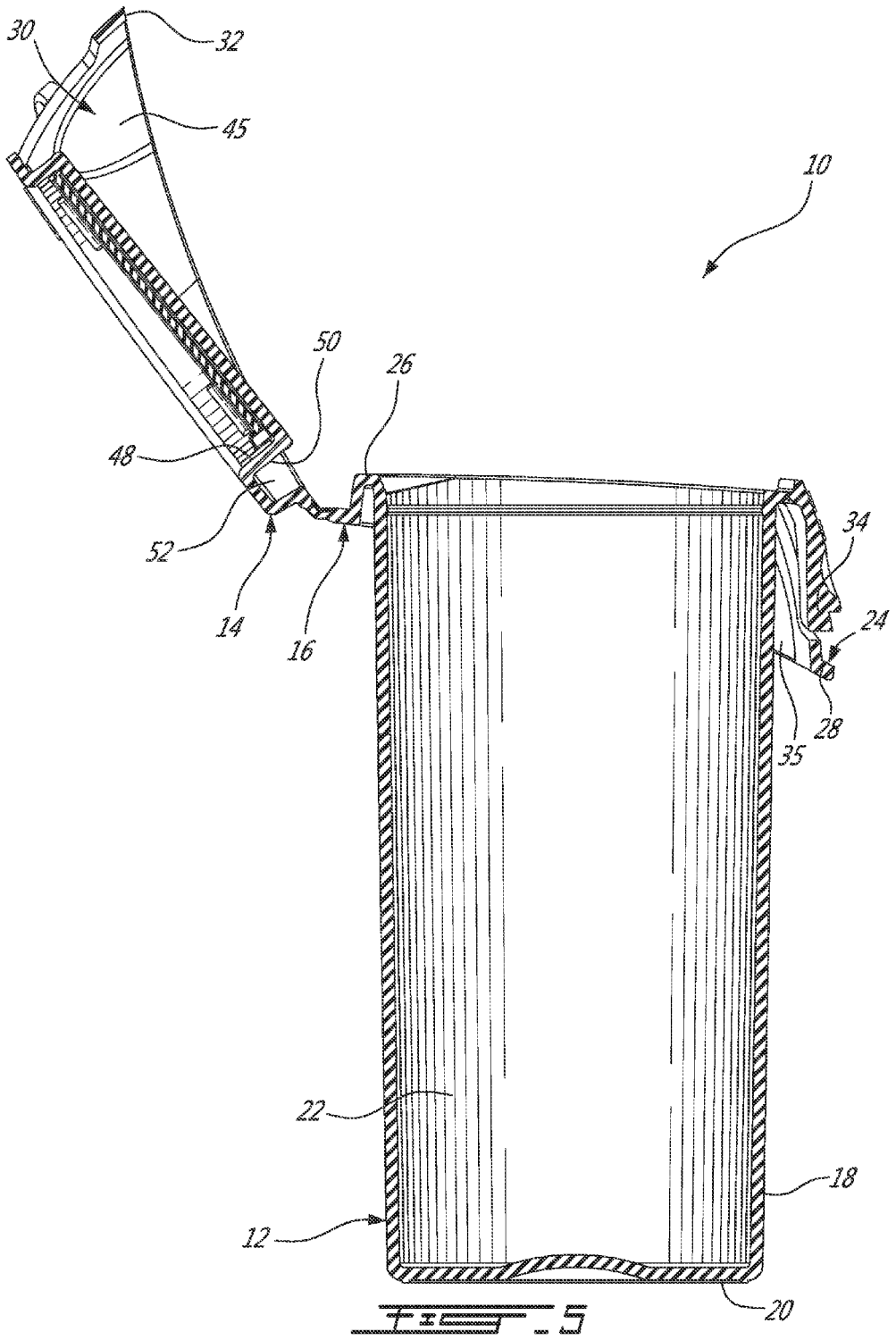
FIG. 5 is a side sectional view of the vial from FIG. 1, showing the vial opened.

An illustrated embodiment of a humidity-proof and child-resistant vial 10 will now be described with reference to FIGS. 1-2 and 4-5.

The vial 10 comprises a container 12 and an integral cap 14, hingedly mounted to the container 12 via an integral hinge 16. The container 12, cap 14 and hinge 16 together define a one piece body which is obtained through conventional molding process using a polymeric material such as copolymeric polypropylene. Other material, which can, for example, further be bio-degradable, can also be used.

The container 12 includes a hollow cylindrical portion, defined by a circular peripheral wall 18 and a bottom 20. Together, the wall 18 and bottom 20 defines a cavity 22.

The container 12 also includes a skirt 24 slanting outwardly and downwardly from the upper edge 26 of the container 12. The skirt 24 has a length that gradually increases on both sides from the hinge 16 to the diametrically opposite position.

The edge of the skirt 24 is provided with a peripheral flange 28. As will become more apparent upon reading the following description, the cap 14 includes an outer skirt 30 that overlays the skirt 24 in a complementary fashion when the vial 10 is closed. In such a closed configuration of the vial 10, the edge 32 of the skirt 30 abuts the flange 28 from above so as to prevent access to the cap 14 from below the skirt 24. The skirt 24 further includes two embossed side portions 35, the purpose of which will be described hereinbelow in more detail.

The container 12 further includes a first latching element in the form of a tab 34 attached by its upper edge 36 to the upper edge 26 of the skirt 24 at a position diametrically opposite the hinge 16. At this position, the skirt 24 includes a generally trapezoid cut 38 that receives the tab 34. The cut 38 is slightly greater than the tab 34 so as to allow tilting movement of the trigger 34 within the cut 38 towards the peripheral wall 18 of the container 12 about the attachment 36.

The cut 38 is distanced from the flange 28, leaving a narrow portion 39 of the skirt 24 below the tab 34. The portion 39 acts as a tab guard that limits access to the tab 34 from below. For example, an infant or child would be prevented from accessing the tab 34 with its teeth from under the tab 34.

The tab 34 is tapered so as to be thicker near the bottom edge thereof. As will be described hereinbelow in more detail, the tab 34 further acts as a trigger and both terms will be used interchangeably herein when referring to the element 34. The tab 34 includes an ergonomical oval thumb-receiving recess 40 on its front side 42 near the bottom edge. The bottom edge of the tab 34 is cut along its width, defining a shoulder 44.

As described hereinabove, the cap 14 includes an outer skirt 30 that complementary covers the skirt 24 of the container up to the flange 28 when the vial 10 is closed. The outer skirt 30 includes two embossed side portions 45 that cover the corresponding side portions 35 on the container 12 skirt 24. Each portion 45 includes a protrusion 46 that extends substantially along its width at the top thereof. The embossed side portions 45 and the protrusions 46 together define finger-receiving portions that contribute to help lifting the cap 14 to open the vial 10 when the trigger 34 is depressed using the other hand.

The cap 14 includes a circular recess 48 on its outer side. The recess 48 yields an annular wall 50 on its inner side.

The skirt 30 and annular wall 50 are configured and sized so as to yield a gap 52 therebetween that allows receiving in a complementary manner the upper portion of the container's skirt 24 therein when the cap 14 is pivoted thereon.

The front portion of the skirt 30 includes a second latching element in the form of a cut out 54 that allows passage to the tab 34 therethrough. The cut out 54 is configured so as to be hooked by the shoulder 44 when the container 12 is closed by the cap 14.

The cut out 54 is so shaped and sized so that the portion of the cut 38 below the shoulder 44 is substantially covered. It results from this that an infant or any other person would be prevented to open the vial 10 by an inadvertent pushing on the trigger 34 from below thereof while simultaneously tilting up the cap 14, for example using his/her teeth.

Figure 6:
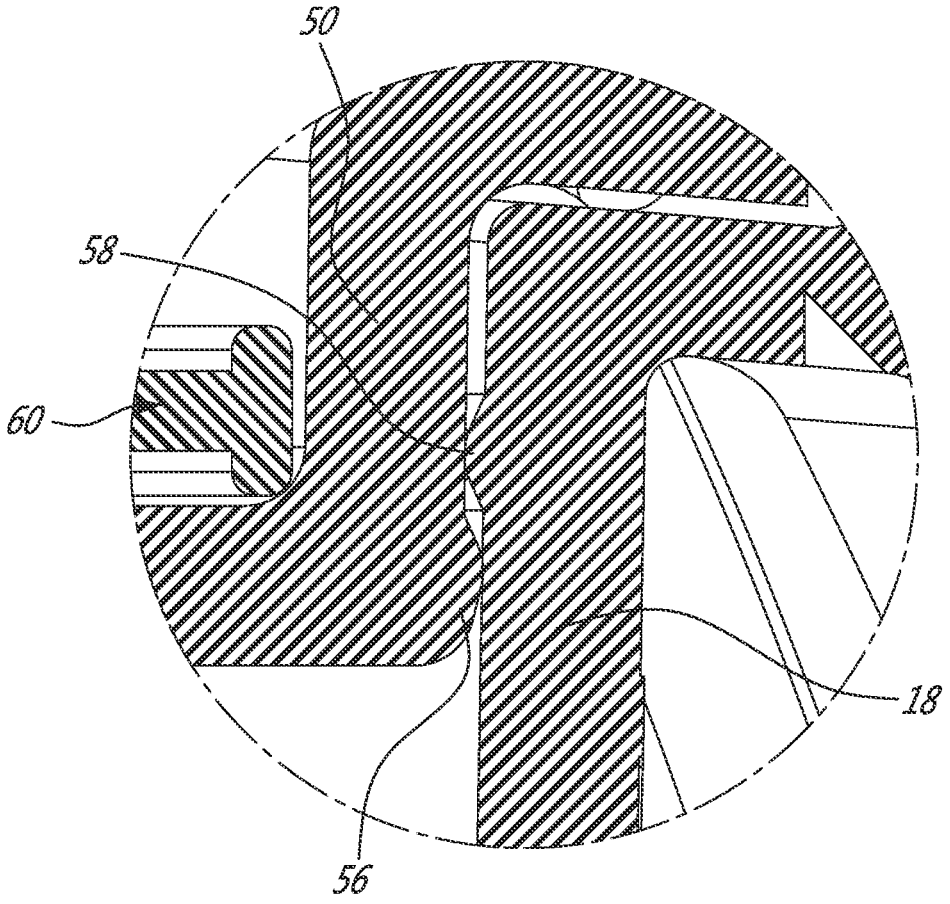
FIG. 6 is a close-up view taken within line 6-6 from FIG. 4.

Turning briefly to FIG. 6, both the distal edge of the wall 50 and the inner wall of the container 12 include respective sealing rings in the form of protruding lips 56 and 58. The sealing rings 56 and 58 are so positioned as to be adjacent when the vial 10 is closed by the cap 14.

In operation, the vial 10 can be closed by pivoting the cap 14 towards the container 12 until the tab 34 is received within the cut out 54. The cap 14 is then automatically locked in a closing position onto the container 12.

In this position, the trigger 34 is prevented from being accessed from all its side, except from its front face, and can only be pushed towards the container wall. Only the combined actions of pushing on the trigger 34 and lifting the cap 14 allows releasing the trigger 34 from the cut out 54.

A person skilled in the art would appreciate that removing the tab 34 by jiggling or cutting it when the cap 14 is opened allows converting the vial 10 from child-resistant to easy opening.

According to some embodiments, the portion of the container 12 behind the tab 34 is provided with writings, marks, symbols, or other (not shown) to indicate to the user that a child safety feature of the vial has been removed. Such an indication can be in the form of a symbol, text, etc. and can be molded on the container, engraved, or affixed using a sticker thereto.

According to such an embodiment, the presence of the tab hides this indication and its removal reveals it.

The circular recess 48 defines a token-receiving portion. More specifically, the recess 48 is configured and sized to receive and hold a disk-shaped token 60. Such a token 60 may be used for example by the pharmacist or a user to add "at-a-glance" information relative to the vial, including without limitations, the identity of the patient, the content of the vial, the time in the day to take a pill contained in the vial 10, etc. For such a purpose, the token 60 might be characterized by a color, inscriptions, engraving or printing thereon, a shape, a size, etc. or any combination thereof.

The token-receiving portion 48 includes elongated restrainers 62, protruding from the inner peripheral wall 63 of the recess 48, that prevents a token 60 inserted thereunder to be unmounted from the recess 48 without being forced. Two aligning guides 64, extending from the recess wall 63 near the hinge 16, are intended to be received in a peripheral notch 66 of the token 60 when it is mounted in the recess 48. In addition to preventing the pivoting of the token 60 within recess 48, the guides 64 further act as aligning means for the token 60. Indeed, according to the first illustrative embodiment, the token 60 includes a marketing or informational logo 68 that can be properly oriented, for example in relation to the trigger 34.

Prior to using the vial 10, or at any time, a token 60 can be inserted in the recess 48 by snapping the token 60 while it is oriented so that the guides 64 are positioned within the notch 66.

Figure 7:
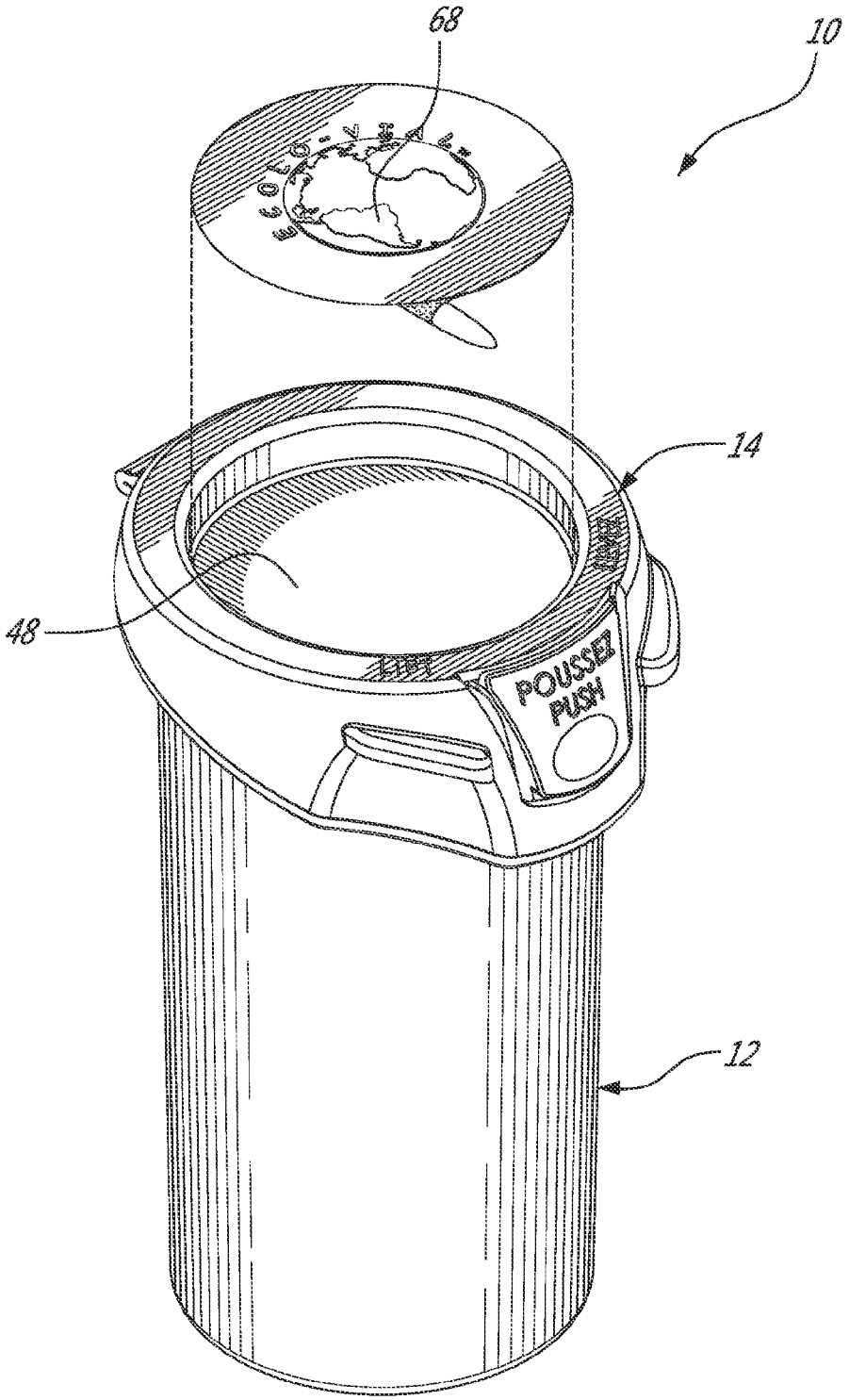
FIG. 7 is a perspective view of the vial from FIG. 1, showing an identification element in the form of a label sticker.

As shown in FIG. 7, the recess 48 can be used to receive another identification element than a token 60. For example, a self-adhesive label sticker 68 can be used. The sticker 68 is shaped and sized for generally complementing the recess 48. The sticker 68 may include colors, symbols, text or more generally marks and writings or any combination thereof. Also, the configuration, dimensions and finish are not limited to the illustrated embodiment.

Figure 8:
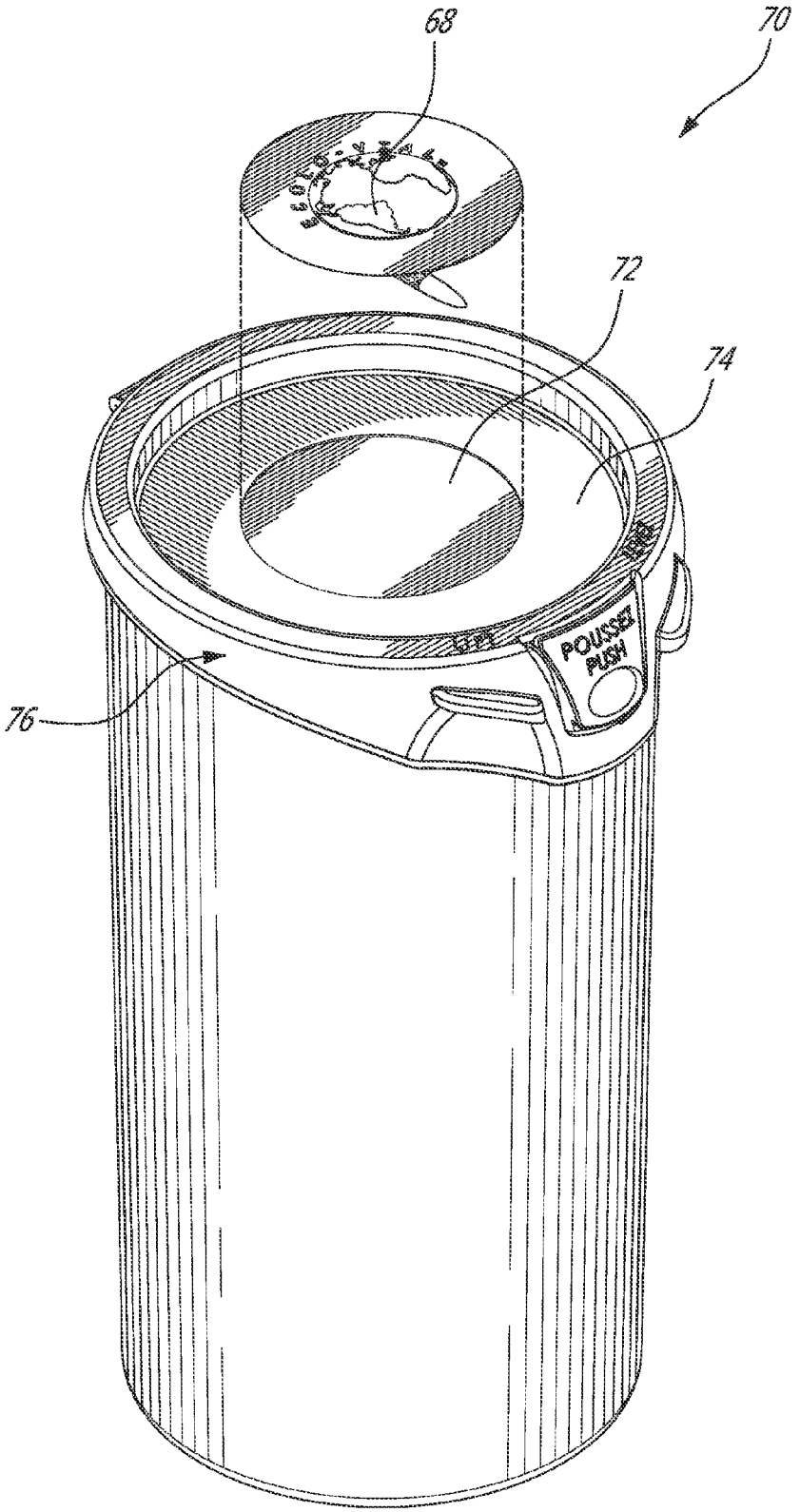
FIG. 8 is a perspective view of a vial according to a second embodiment, shown before an identification label sticker is affixed onto the cap.

FIG. 8 illustrates a vial 70 according to a second embodiment. Since the vial 70 is similar to the vial 10, only the differences therebetween will be described herein in more detail for concision purposes.

The vial 70 is bigger than the vial 10 and includes a round sticker receiving recess 72 that is concentric with the main recess 74 of the cap 76. According to the second embodiment, the diameter of the sticker-receiving recess 72 is generally equal to the main recess 48 of the smaller vial 10. Thus, the recess 72 serves as a sticker placement guide for sticker 68 of the same size than those adapted for the dimension of the recess 48 of the vial 10.

The sticker-receiving recess 72 is not limited to be co-centrically positioned with regards to the main recess 74 of the cap 76.

It is to be noted that modifications could be made to the vial 10 or 70 described hereinabove, for example:

- the trigger can be positioned at other locations than diametrically opposite the hinge 16;
- the trigger can be configured differently than illustrated. For example, it can still be attached to the skirt 24 of the container 12 from its bottom or side edge;
- the angle of the skirts 24 and 30 can be different than illustrated;
- the flange 28 can be more or less narrow than illustrated;
- the token-receiving portion on the cap can be omitted or may be configured with other token attachments than those illustrated. It can also be configured for receiving other element than a disk-shaped token or a sticker;
- the hinge 16 can be configured to further bias the cap 14 towards or away the container 12;
- the embossed finger-receiving portions can be omitted, or take another form;
- the cap can be provided with any configuration of friction elements to ease the grip thereon;
- the number and configuration of the sealing members between the cap and container may be different than illustrated herein; and the dimensions of the vial may vary depending, for example, on the application.

Embodiments of the vial can be used to contain medicine, toxic matter or any other substance that has to be kept out of reach of children. It can also be used to contain non-toxic matter also.

It is to be understood that the humidity-proof and child-resistant vial is not limited in its application to the details of construction and parts illustrated in the accompanying drawings and described hereinabove. The vial is capable of other embodiments and of being practiced in various ways.

For example, the container can take other form than a cylindrical body. The shape and configuration of the container and/or of its aperture can also be regular or irregular.

Although the present invention has been described hereinabove by way of illustrated embodiments thereof, it can be modified. It is therefore to be understood that numerous modifications may be made to the illustrative embodiments and that the scope of the claims should not be limited by the preferred embodiment, but should be given the broadest interpretation consistent with the description as a whole.

What is claimed is:

1. A child-resistant vial comprising:

a container having a first peripheral skirt provided with an edge that includes a peripheral flange;

a cap pivotally mounted to the container via a hinge that is integral to both the cap and container, the container being closable by pivoting the cap onto the container, the cap having a second peripheral skirt that generally overlays the first peripheral skirt in a complementary fashion when the container is closed by the cap, the second skirt having an edge that abuts the peripheral flange of the first skirt when the container is closed by the cap so as to close access to the edge of the second skirt;

a first latching element in the form of a tab that protrudes from the first skirt generally parallel thereto and that has a free distal end;

a second latching element, in the form of a cut out portion in the second skirt, that cooperates with the tab to lock the vial when the container is closed by the cap, when the vial is locked, the tab is prevented from being released from the cut out portion unless simultaneous pressing on the tab and pulling on the cap; and a tab guard on the first skirt, that closes access to the free end of the tab when the container is closed by the cap.

2. The child-resistant vial of claim 1, wherein the tab includes a cut defining a shoulder at a bottom edge of the tab, the cut out portion being configured so as to be hooked by the shoulder when the container is closed by the cap; and wherein the simultaneous pressing on the tab and pulling on the cap causes the cut out to be unhooked from the shoulder.

3. The child-resistant vial of claim 2, wherein a portion of the tab below the shoulder is covered by a portion of the second skirt below the cut out.

4. The child-resistant vial of claim 1, wherein the tab is defined by a cut in the first skirt.

5. The child-resistant vial of claim 4, wherein the tab guard is defined by a portion of the first skirt under the cut.

6. The child-resistant vial of claim 1, wherein the cap includes a recess.

7. The child-resistant vial of claim 6, wherein the recess defines internal and external walls of the cap, yielding a gap therebetween that is configured to receive an upper portion of the first skirt therein.

8. The child-resistant vial of claim 7, wherein at least one of an inner wall of the container and an inner wall of the internal wall of the cap includes a sealing ring.

9. The child-resistant vial of claim 7, wherein each of an inner wall of the container and an inner wall of the internal wall of the cap includes a sealing ring.

10. The child-resistant vial of claim 9, wherein both sealing rings are adjacent when the container is closed by the cap.

11. The child-resistant vial of claim 6, wherein the recess includes a receiving portion for an identification element.

12. The child-resistant vial of claim 11, wherein the identification element is a token or a sticker.

13. The child-resistant vial of claim 1, wherein the tab is attached to an upper edge of the first skirt.

14. The child-resistant vial of claim 1, wherein the tab includes a finger-receiving recess on a front face thereof.

15. The child-resistant vial of claim 1, wherein the second skirt includes at least one of i) an embossed finger-receiving portion and ii) a finger receiving protrusion.

16. The child-resistant vial of claim 15, wherein the second skirt includes two adjacent pairs of the embossed finger-receiving portion and the finger receiving protrusion.

17. The child-resistant vial of claim 1, wherein the first and second skirts extend downwardly respectively from the container and the cap.

18. The child-resistant vial of claim 17, wherein the first and second skirts both have a length that increases from the hinge to the first and second latching elements.

19. The child-resistant vial of claim 1, wherein both the tab and the cut out portion are trapezoid-shaped.

20. The child-resistant vial of claim 1, wherein the vial is a one-piece body made of a polymeric material.

21. The child-resistant vial of claim 1, wherein the tab is removable to convert the vial from child-resistant to easy opening.

22. A child-resistant vial comprising:

a container having a first peripheral skirt provided with an edge that includes a peripheral flange;

a cap pivotally mounted to the container via a hinge that is integral to both the cap and container, the container being closable by pivoting the cap onto the container, the cap having a second peripheral skirt that generally overlays the first peripheral skirt in a complementary fashion when the container is closed by the cap, the second skirt having an edge that abuts the peripheral flange of the first skirt when the container is closed by the cap so as to prevent access to the edge of the second skirt, the cap having a recess defining internal and external walls of the cap, yielding a gap therebetween that receives an upper portion of the first skirt therein, each of an inner wall of the container and an inner wall of the internal wall of the cap including a sealing ring;

a first latching element in the form of a tab that protrudes from the first skirt generally parallel thereto and that has a free distal end;

a second latching element in the form of a cut out portion in the second skirt, that cooperates with the tab to lock the vial when the container is closed by the cap, when the vial is locked, the tab is prevented from being released from the cut out portion unless simultaneous pressing on the tab and pulling on the cap; and a tab guard on the first skirt, that prevents access to the free end of the tab when the container is closed by the cap.

23. The child-resistant vial of claim 22, wherein the recess includes an identification element receiving portion.

* * * * *